US011643309B2

(12) United States Patent
Iotti

(10) Patent No.: US 11,643,309 B2
(45) Date of Patent: May 9, 2023

(54) ROTARY TOWER WITH BALLAST

(71) Applicant: MANITOU ITALIA S.R.L., Castelfranco Emilia (IT)

(72) Inventor: Marco Iotti, Reggio Emilia (IT)

(73) Assignee: MANITOU ITALIA S.R.L., Castelfranco Emilia (IT)

( * ) Notice: Subject to any disclaimer, the term of this patent is extended or adjusted under 35 U.S.C. 154(b) by 165 days.

(21) Appl. No.: 17/109,717

(22) Filed: Dec. 2, 2020

(65) Prior Publication Data

US 2021/0179404 A1 Jun. 17, 2021

(30) Foreign Application Priority Data

Dec. 11, 2019 (IT) ..... 102019000023631

(51) Int. Cl.
*B66F 9/075* (2006.01)
*B66F 9/065* (2006.01)

(52) U.S. Cl.
CPC ..... *B66F 9/07554* (2013.01); *B66F 9/065* (2013.01); *B66F 9/0755* (2013.01); *B66F 9/0759* (2013.01)

(58) Field of Classification Search
CPC .... B66F 9/07554; B66F 9/0755; B66F 9/065; B66C 23/72; E02F 9/18; E02F 9/2033
See application file for complete search history.

(56) References Cited

U.S. PATENT DOCUMENTS 10,124,994 B2 11/2018 Torghele
10,527,731 B2 1/2020 Kinoshita et al.
2012/0327261 A1* 12/2012 Tafazoli Bilandi ..... E02F 9/24 348/E5.022
2016/0221804 A1 8/2016 Torghele
2019/0170879 A1 6/2019 Kinoshita et al.
2021/0300731 A1* 9/2021 Matsushita ..... B66C 13/46

FOREIGN PATENT DOCUMENTS

| | | | | |
|---|---|---|---|---|
| CA | 3042810 A1 | * | 11/2019 | |
| CN | 106064794 A | * | 11/2016 | |
| CN | 106219447 A | | 12/2016 | |
| DE | 102020214291 B3 | * | 3/2022 | ..... B66C 13/46 |
| EP | 3477006 B1 | | 9/2020 | |
| JP | 07317108 A | * | 12/1995 | ..... E02F 9/2033 |
| JP | H07317108 A | | 12/1995 | |
| JP | 2012045979 A | * | 3/2012 | |
| KR | 20120084872 A | | 7/2012 | |
| RU | 2652303 | | 4/2018 | |

OTHER PUBLICATIONS

Miyaoka, Rear End Interference Preventive Device of Upper Side Turning Body, Dec. 5, 1995, EPO, JP 07317108 A, Machine Translation of Description (Year: 1995).*

* cited by examiner

*Primary Examiner* — Paul N Dickson
*Assistant Examiner* — Matthew D Lee
(74) *Attorney, Agent, or Firm* — Pearne & Gordon LLP; J. Gregory Chrisman

(57) ABSTRACT

Described is ballast for a rotary tower, comprising: a main body (10), equipped with coupling means designed to allow a connection to the rotary tower; a detecting device (11, 12, 13), associated with the main body (10), designed for detecting the presence of an obstacle positioned at a distance less than a predetermined safety distance from the main body (10), and for emitting a proximity signal, signifying the presence of an obstacle at a distance less than the safety distance from the main body (10).

8 Claims, 2 Drawing Sheets

ROTARY TOWER WITH BALLAST

This invention relates to a rotary tower equipped with ballast.

More specifically, but not exclusively, the invention relates to a rotary tower equipped with ballast for an operator vehicle.

In the operator vehicles equipped with a rotary tower, use is made of a ballast for at least partly counterbalancing the weight of an apparatus, such as, for example, an operator arm or other tool, associated with the rotary tower itself, which also supports the operating cabin.

The rotary tower is provided with the possibility of rotating relative to the vehicle about a main axis, normally perpendicular to the supporting surface of the vehicle. The rotation available for the tower is typically a full and multiple circles, in both directions.

Since the operator arm or other tool associated with the rotary tower often has quite a significant weight, the ballast associated with the tower also has an equally significant weight, so as to provide a suitable balancing for the operator arm. The ballast, consequently, also has considerable dimensions, which must be taken into account during the rotation of the tower.

In fact, the ballast is normally located behind the driver's cab, in a position opposite the operator arm relative to the axis of rotation of the tower, protruding laterally to the driver's cab.

By performing the rotation of the tower, the operator must therefore ensure that the circular trajectory followed by the ballast is free from obstacles, so as not to produce impacts which could trigger dangerous oscillations of the tower and of the vehicle. On the other hand, the attention of the operator is directed mainly to the operator arm and the maneuvering of the latter, so that the risk that the ballast can strike an obstacle cannot be excluded. Currently, there are no operator aids for controlling the trajectory followed by the ballast during rotation of the tower.

The aim of the invention is to provide a rotary tower equipped with ballast which allows the above-mentioned drawback to be overcome, providing an aid to the operator for controlling the trajectory followed by the ballast.

Features and advantages of the invention are more apparent from the detailed description which follows of an embodiment of the invention according to the invention, illustrated by way of a non-limiting example in the accompanying drawings in which:—

The ballast according to the invention comprises a main body (10), equipped with coupling means designed to allow a connection to the rotary tower of an operator vehicle.

Figure 1:
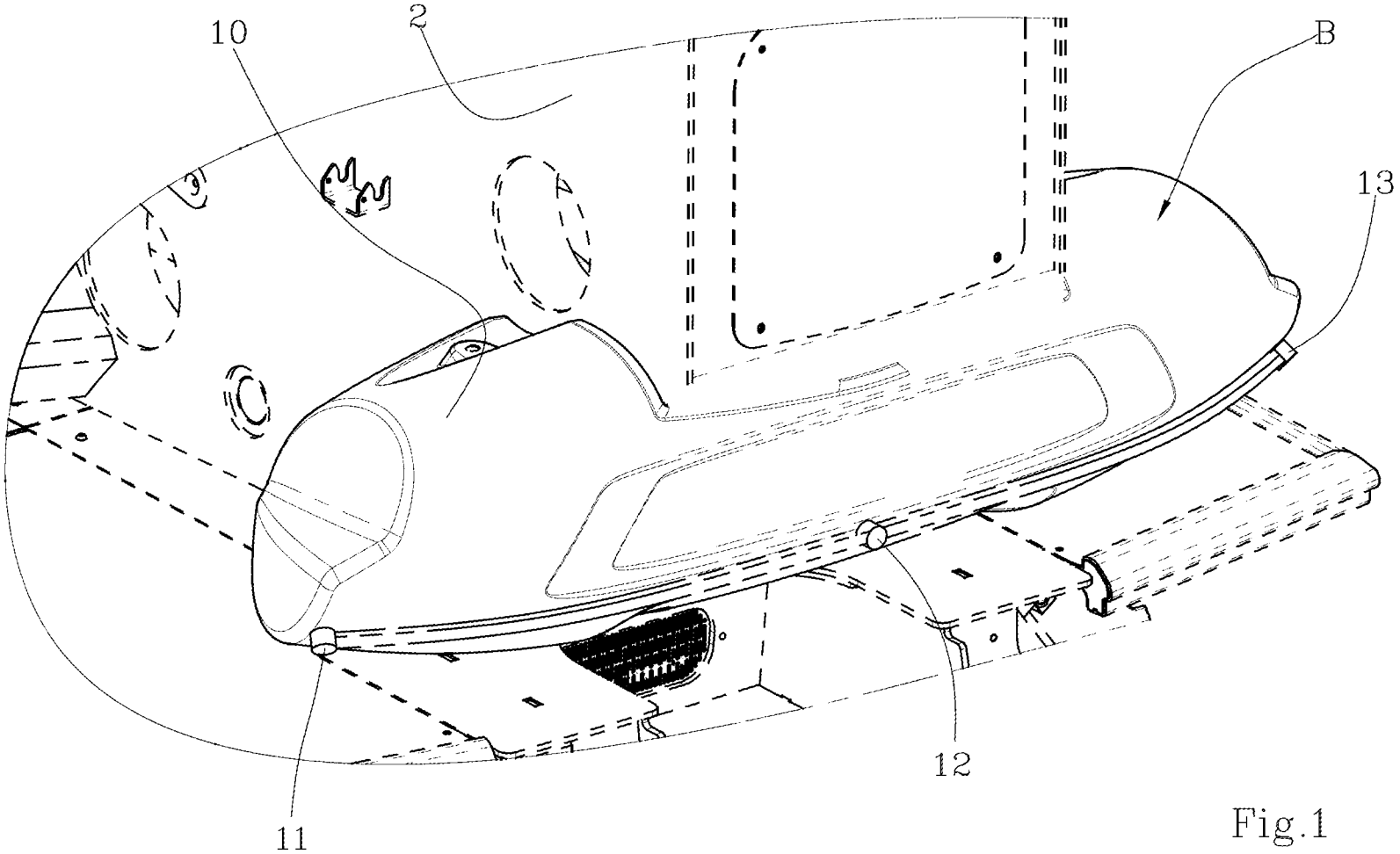
FIG. 1 is an isometric view of a ballast according to the invention.
Figure 2:
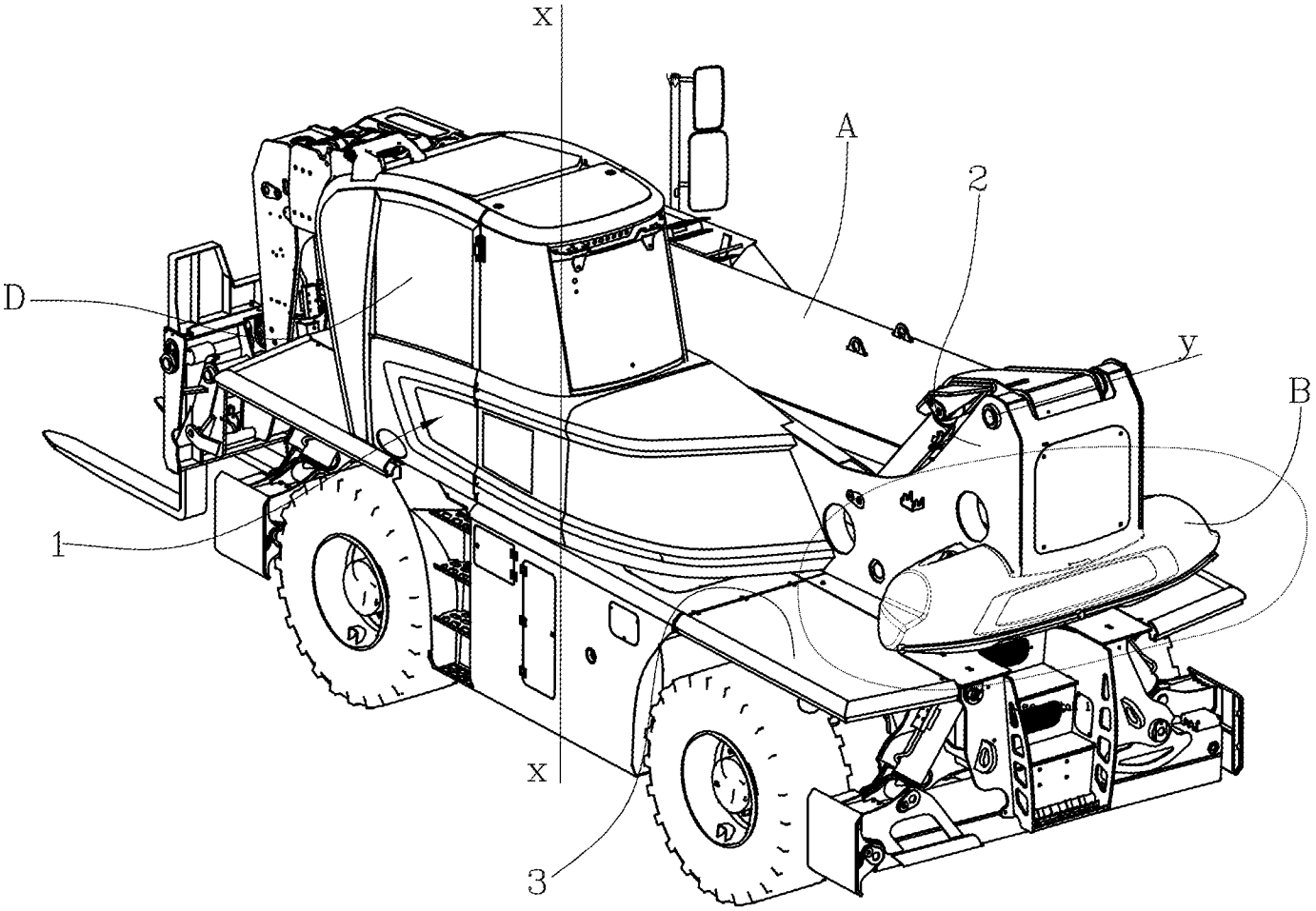
FIG. 2 is an isometric view of an operator vehicle equipped with a ballast according to the invention.

As shown in FIG. 2, the operator vehicle comprises a platform (3), equipped with movement means, structured to allow the resting and the movement on a ground of the platform. In short, the platform (3) is the part of the vehicle which comprises the load-bearing frame, to which the means of movement, the motor and other devices for driving and controlling the vehicle are associated. Depending on the type of vehicle, the size and the tools supported, the platform (3) has different features, known in the trade. In FIG. 2 the movement means consist of wheels, but according to other embodiments, known in the sector, the movement means could also comprise tracks and/or further wheels. The movement means are connected to a main motor, for receiving the drive force produced by the motor.

The operator vehicle is provided with a tower (1), equipped with a frame (2) connected to the platform (3) in a rotary fashion about a main axis (X). According to the non-limiting example embodiment illustrated, the tower (1) supports an apparatus (A), in the form of a telescopic arm, articulated to the frame (2) of the tower (1) about a horizontal axis of rotation (Y). In known manner, the telescopic arm can rotate about the horizontal axis (Y) to adopt different inclinations on a vertical plane. The tower (1) also carries a driving position (D) for an operator, equipped with the controls necessary for driving and operating the vehicle and the apparatus (A).

A rotary motor, of the type known in the sector, is designed for producing the rotation of the tower (1) relative to the platform (3) about the main axis (X); preferably, the rotary motor is of the hydraulic type and is driven by a distributor subject to the control signals sent by the control unit.

The ballast (B) according to the invention is associated with the frame (2) of the tower (1). According to the non-limiting example embodiment illustrated, the ballast (B) is associated with the frame (2) under the articulated end of the apparatus (A), that is, of the telescopic arm. The ballast (B) is located in a zone behind the driving position (D), that is to say, it is located behind the operator.

The ballast (B) comprises a detecting device (11, 12, 13), associated with the main body (10). The detecting device is designed for detecting the presence of an obstacle positioned at a distance which is less than a predetermined safety distance from the main body (10). Moreover, the detecting device is designed for emitting a proximity signal, indicating the presence of an obstacle at a distance which is less than the safety distance from the main body (10).

In short, the detecting device is able to perceive the presence of an obstacle which is closer to the main body (10) than a predetermined safety distance, and emit a corresponding signal, which may be transmitted directly to the operator, in the form of an acoustic or visual signal, and/or can be transmitted to a control unit, as described in more detail below. If, during the rotation of the tower (1), the ballast (B) moves closer to an obstacle than a predetermined safety distance, the detecting device emits the relative proximity signal. The proximity signal can be sent directly to the operator, who can slow down and/or stop the rotary motor, stopping the ballast before impact against the obstacle. Alternatively or in combination with the proximity signal transmitted to the operator, the proximity signal may be transmitted to the control unit, which can act on the rotary motor.

In particular, the operator vehicle is equipped with a control module, for example provided in the control unit, connected to the detecting device (11, 12, 13) and to the rotary motor, which is designed to transmit control signals to the above-mentioned distributor, in such a way that this drives the rotary motor as a function of the proximity signal emitted by the detecting device (11, 12, 13). According to a preferred, non-limiting embodiment, the control module is set up to slow down and/or stop the rotary motor (through the distributor), in the presence of the proximity signal. In other words, the control module is able to slow down, and stop at the suitable moment, the rotation of the tower (1), acting on the distributor which in turn controls the rotary motor, to prevent the ballast (B) from striking the obstacle. This function is performed by the control module thanks to a suitable algorithm. The stopping of the rotation of the tower (1) is preceded by a slowing down suitable for preventing the triggering of oscillations.

According to a possible embodiment, the detecting device (11, 12, 13) comprises one or more proximity sensors. For example, the proximity sensors are ultrasound sensors or radar sensors. In any case, one skilled in the trade is able to select a proximity sensor who uses a technology suitable for the planned use. The proximity sensors are positioned in the most protruding zones of the main body (10). For example, according to the embodiment illustrated, the main body (10) has an ogival shape, elongate along a substantially horizontal direction. The detecting device comprises a sensor (12) located in a central or middle position of the main body (10), and two lateral sensors (11, 13), located at the ends of the main body (10). Obviously, the sensors face towards the outside of the vehicle. Thanks to the ballast according to the invention, in both the presence of a control module and in the presence of a proximity signal transmitted directly in visual or acoustic form, the operator can calmly rotate the tower, concentrating mainly on the operation of the apparatus (A). This is because the detecting device, either directly, or indirectly through the control module, warns the operator of the presence of an obstacle along the trajectory of the ballast (B), allowing a timely stopping of the rotation of the tower, preceded by a slowing down suitable to prevent the triggering of oscillations.

The invention claimed is:

1. An operator vehicle, comprising:

a platform (3), equipped with movement means, structured to allow the resting and the movement on a ground of the platform;

a main motor connected to the movement means;

a tower (1), equipped with a frame (2) connected to the platform (3) in a rotary fashion about a main axis (X);

a rotary motor, designed to rotate the tower (1) relative to the platform (3) about the main axis (X);

characterised in that the operator vehicle comprises a ballast (B) associated with the frame (2) of the tower (1); wherein the ballast (B) comprises a main body (10), equipped with coupling means which allow a connection to the tower (1), characterised in that the ballast (B) comprises a detecting device (11, 12, 13), associated with the main body (10), designed for detecting the presence of an obstacle positioned at a distance less than a predetermined safety distance from the main body (10), and for emitting a proximity signal, signifying the presence of an obstacle at a distance less than the safety distance from the main body (10).

2. The operator vehicle according to claim 1, comprising a control module, connected to the detecting device (11, 12, 13) and to the rotary motor, which is designed to drive the rotary motor as a function of the proximity signal emitted by the detecting device (11, 12, 13).

3. The operator vehicle according to claim 2, wherein the control module is designed to slow down and/or stop the rotary motor in the presence of the proximity signal.

4. The operator vehicle according to claim 1, wherein the detecting device (21, 22, 23) comprises one or more proximity sensors.

5. The operator vehicle according to claim 4, wherein the proximity sensors are ultrasound sensors or radar sensors.

6. The operator vehicle according to claim 1, wherein the frame (2) supports an apparatus (A).

7. The operator vehicle according to claim 1, wherein the tower (1) carries a driving position (D) for an operator.

8. The operator vehicle according to claim 7, wherein the driving position (D) is equipped with controls for driving and operating the operator vehicle and for operating an apparatus (A).

* * * * *